United States Patent [19]

Pineau

[11] Patent Number: 4,698,255

[45] Date of Patent: Oct. 6, 1987

[54] MULTI-LAYER REFRACTORY STRUCTURE AND A WALL PROVIDED WITH SUCH A REFRACTORY STRUCTURE

[75] Inventor: Didier Pineau, Bordeaux, France

[73] Assignee: Societe Nationale Industrielle et Aerospatiale, Paris, France

[21] Appl. No.: 9,780

[22] Filed: Feb. 2, 1987

Related U.S. Application Data

[63] Continuation-in-part of Ser. No. 824,519, Jan. 31, 1986.

[30] Foreign Application Priority Data

Feb. 15, 1985 [FR] France ..... 85 02246

[51] Int. Cl.[4] ..... C04B 35/52

[52] U.S. Cl. ..... 428/215; 428/218; 428/701; 428/703; 52/612

[58] Field of Search ..... 428/36, 215, 218, 469, 428/703, 701; 138/145, 149, 141, 175, 146; 266/280

[56] References Cited

U.S. PATENT DOCUMENTS

| | | | |
|---|---|---|---|
| 4,001,029 | 1/1977 | Cassens | 266/280 |
| 4,007,048 | 2/1977 | Sack | 501/70 |
| 4,093,193 | 6/1978 | Cassidy | 138/144 |
| 4,152,166 | 5/1979 | Rogers | 501/87 |
| 4,202,148 | 5/1980 | Frahme | 52/506 |
| 4,248,023 | 2/1981 | Dunlap | 428/300 |
| 4,296,921 | 10/1981 | Hsyashi | 138/144 |
| 4,323,620 | 4/1982 | Iwabuchi | 428/215 |
| 4,381,716 | 5/1983 | Hastings | 428/251 |
| 4,471,017 | 9/1984 | Poeschel | 428/215 |
| 4,523,528 | 6/1985 | Hastings | 428/282 |

*Primary Examiner*—Henry E. Raduazo

*Attorney, Agent, or Firm*—Marshall, O'Toole, Gerstein, Murray & Bicknell

[57] ABSTRACT

A multi-layer refractory structure is provided capable of withstanding high temperatures of the order of 2000° C. to 2500° C. for hundreds of hours. This structure comprises at least two layers, the first of which, subjected directly to said high temperatures and formed by a simple or composite metal oxide or a zirconate, has a thickness between about 1 mm and 4 mm and a specific gravity between about 2.2 and 4.8 and the second layer of which, which serves as support for said first layer, is of the same nature as this latter and has a thickness between about 5 mm and 12 mm and a specific gravity between about 2.2 and 4.2.

7 Claims, 2 Drawing Figures

MULTI-LAYER REFRACTORY STRUCTURE AND A WALL PROVIDED WITH SUCH A REFRACTORY STRUCTURE

This is a continuation-in-part of copending application Ser. No. 824,519, filed Jan. 31, 1986.

BACKGROUND OF THE INVENTION

1. Field of the Invention

The present invention relates to a multi-layer refractory structure able to withstand high temperatures of the order of 2000° C. to 2500° C. for hundreds of hours. Although not exclusively, it is particularly appropriate for the formation of refractory linings for ducts intended to convey hot gas flows and it will be more especially described hereafter in this application.

2. Description of the Prior Art

It is known that such ducts are used in numerous industrial installations employing gases at very high temperatures, such more particularly as furnaces, steel and iron plants or coal distillation plants.

For conveying high temperature gas flows, the prior technique is familiar with two types of ducts:

on the one hand, metal ducts cooled by a fluid, such as water; these ducts may withstand high temperatures but, because of the liquid cooling, they are complicated to manufacture, entail considerable constaints and are the source of considerable heat losses. Thus, such ducts are not only costly to manufacture and maintain but they are also the cause of low heat yields;

on the other hand, metal ducts, not cooled by a fluid, comprising an internal refractory lining; these ducts overcome the drawbacks of the cooled ducts, but on the other hand cannot be used for conveying very high hot gas flows, because of the poor heat resistance of known refractory linings. In practice, such uncooled ducts cannot be used when the temperature of the gas flows exceeds 1300° C.

Now, new heating means are known at the present time, such as plasma generators, providing very high temperatures and it is often advantageous in certain industrial processes to increase the operating temperatures so as to obtain more complete and/or more rapid reactions.

For example, it is often desirable to increase as much as possible the temperature of the blowing gas in a blast furnace, so as to increase the production and reduce the amount of coke required for operating said blast furnace.

To this end, it is already known to equip a blast furnace with a plasma generator and to connect the output of said plasma generator to the duct feeding the blowing gas to the nozzle injecting it into said blast furnace. Such a technique is described for example in the patents FR-A No. 2 223 449, FR-A No. 2 223 647, GB-A No. 1 488 976, U.S. Pat. No. 4,363,656 and FR-A No. 2 515 326.

However, this technique raises practical difficulties because of the very high temperature (several thousand °C.) of the plasma generated by the generator. Penetrating into the duct of the blowing gas and coming into contact with the walls thereof, the plasma causes accelerated wear and destruction of said walls. In U.S. Pat. No. 4,363,656, this drawback has already been noted in connection with the technique described in the patent GB-A No. 1 488 976 and to overcome it, it has already been proposed to slant the axes of the plasma generator and of the blowing gas duct with respect to the axis of the nozzle injecting into the blast furnace. The result is a bend between the blowing duct and the nozzle which may generate disturbances in the flow of the blowing gas. In addition, such a solution is not easy to implement for improving a preexisting blast furnace.

SUMMARY OF THE INVENTION

The object of the present invention is therefore a refractory structure, intended more particularly to form an internal duct lining, capable of withstanding high temperatures of the order of 2000° C. to 2500° C. for hundreds of hours. Advantageously, the present invention more particularly allows new heating means such as plasma generators, to be adapted to existing industrial installations for increasing the efficiency thereof.

To this end, in accordance with the invention, the multi-layer refractory structure capable of withstanding high temperatures of the order of 2000° C. to 2500° C. for hundreds of hours is remarkable in that it comprises at least two layers, the first of which, directly subjected to said high temperatures and formed from a simple or composite metal oxide or a zirconate, has a thickness between about 1 mm and 4 mm and a specific gravity between about 2.2 and 4.8 and the second layer of which, which serves as support for said first layer, is of the same nature as this latter and has a thickness between about 5 mm and 12 mm and a specific gravity between about 2.2 and 4.2.

Thus, said first layer is fine and is formed of a solid ceramic which is little porous, whose maximum temperature of use is compatible with temperatures to be withstood. In addition, it has great chemical inertia, with respect to most of the hot gases transported in the ducts of industrial installation. In order to be able to have great purity and low porosity (and so great resistance to high temperatures), this first layer may be formed by sintering or by any other process allowing such characteristics to be obtained, such for example as hot projection. Such a hot projection process is well known and it is described for example in the document FR-A No. 1 443 142. In the present case, the heat source used for the projection of said first layer may advantageously be a plasma generator.

Furthermore, said second layer, already thermally protected by the first one, may be more porous than this latter (so of lower density). In addition, since its heat resistance properties are less critical than those of the first one, its construction is not as difficult and its thickness may therefore be greater. This second layer may also be formed by sintering or by hot projection. In this case, said heat source may be a simple flame (oxyacetylene for example). It will be noted that, since said first and second layers are formed from materials of the same kind, their expansion coefficients are not different one from the other, so that the thermal expansions resulting from the high temperatures to which the structure of the invention is subjected cannot cause sufficiently high stresses for generating fissures, cracks or the like.

In general, said multi-layer refractory structure of the invention may be used for protecting a metal wall, for example a steel duct. In this case, it is advantageous for said structure to comprise a third layer serving as support for said second layer and being formed from refractory concrete having a linear expansion coefficient between about 1.4 and $1.8\times10^{-6}$ per °C. and a thickness at least equal to 20 mm.

Thus, such a third layer ensures the connection between said second layer and said wall and is perfectly compatible, insofar as the expansion coefficients are concerned, not only with said second refractory layer but also with the metal support wall. Since this third layer is protected by said first and second layers, its heat resistance may be lower and may allow it to withstand without damage temperatures of the order of 1500° C. only. Said third layer may be a concrete incorporating a high proportion of alumina, for example of the order of 80%, incorporating a charge for increasing its resistance to thermal shocks.

So that only the lowest possible stresses are applied to the metal wall, it is advantageous to form a layer of great thickness. However, particularly for economic reasons, it may be preferred to limit the thickness of the costly concrete of the third layer and to provide, between said third layer and said wall, a fourth layer made from a less expensive refractory material, for example a silica and clay based concrete, rock wool or a similar raw material. This fourth layer must guarantee the mechanical strength despite the possible differences in the expansion coefficients of the third layer and of the metal wall.

When the multi-layer refractory structure is intended to protect a metal wall, it may be formed progressively, layer by layer, using said wall as support. In this case, the possible fourth layer is formed first of all on said wall, then said third layer on the fourth (or directly on said wall if said fourth layer does not exist), then the second layer on the third one and finally the first one on the second.

As a variant, said structure may be formed at least partially, independently of the wall, by using a mold. In this case, the third layer is formed first of all, or possibly if this third layer does not exist, the second in said mold, then in the first case the second on the third and finally the first on the second. Then, the structure thus obtained is fixed to said wall by means of an intermediate refractory layer, formed of the fourth layer, or if this does not exist, of the third layer.

The present invention also relates to a wall comprising a refractory lining capable of withstanding high temperatures of the order of 2000° C. to 2500° C. for hundreds of hours. Such a wall is for example a duct intended to convey hot gas flows and provided with an internal refractory lining and it is remarkable in that said lining comprises at least two layers, the first of which, directly subjected to said high temperatures and formed by a simple or composite metal oxide or a zirconate, has a thickness between about 1 mm and 4 mm and a specific gravity between about 2.2 and 4.8 and the second layer of which, which serves as support for said first layer, is of the same nature as this latter and has a thickness between about 5 mm and 12 mm and a specific gravity between about 2.2 and 4.2.

Preferably, at least one refractory material layer is provided for connecting between said second layer and said wall.

BRIEF DESCRIPTION OF THE DRAWINGS

The figures of the accompanying drawings will better show how the invention may be put into practice.

DESCRIPTION OF THE PREFERRED EMBODIMENT

Figure 1:
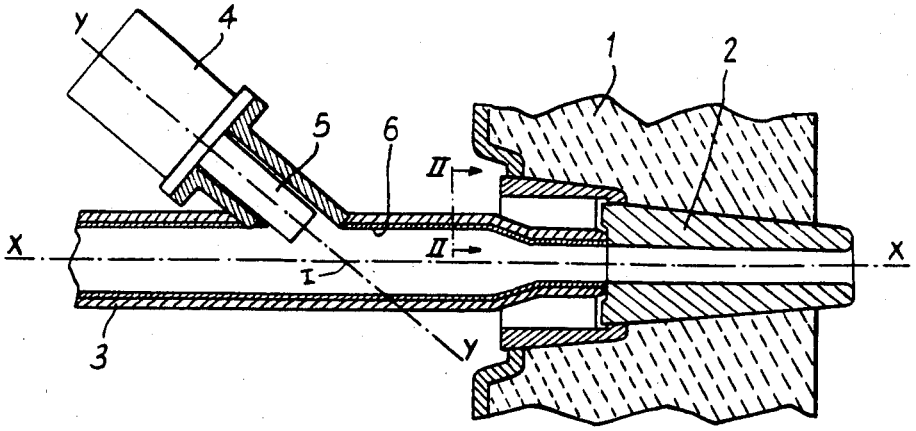
FIG. 1, shows, in partial schematical section, an example of an installation using a multi-layer refractory structure in accordance with the present invention.

In FIG. 1 has been shown a wall portion 1 of a blast furnace, in which there is provided a blowing gas injection nozzle 2. Nozzle 2 is fed with blowing gas by a duct 3. For example, nozzle 2 and duct 3 are aligned and have the same axis X—X.

The blowing gas flowing through duct 3 is for example at a temperature of 1300° C., with a pressure of 1.7 relative bars and its flowrate is for example between 1000 and 6000N m3/h.

Branching into duct 3 there is provided a plasma generator 4 whose nozzle 5 emits a plasma jet through its outlet orifice. Nozzle 5 penetrates into duct 3 and its axis Y—Y forms an acute angle, for example of the order of 40°, with respect to the axis X—X of duct 3. The axes X—X and Y—Y intersect at I.

The plasma jet emitted by the generator 4 is for example at a temperature of 4000° C., with a pressure of 2.5 relative bars and its flowrate is for example between 100 and 1000N m3/h.

If the quantitative data given above, which corresponds to real operation of the blast furnace are respected, the temperature of the mixture downstream of point I is of the order of 2000° C.

Thus, in duct 3, the temperature passes from about 1300° C. (upstream of point I) to about 2000° C. (downstream of point I).

Figure 2:
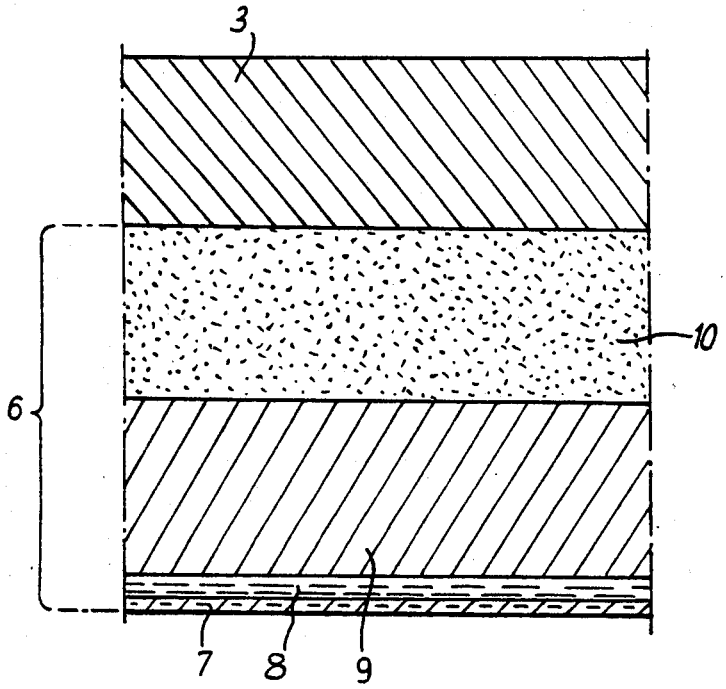
FIG. 2 is a schematical cross section, through line II—II of FIG. 1, of one example of a multi-layer refractory structure for this installation.

As is known, the operation of a blast furnace is continuous, so that duct 3, which is usually made from steel, must be able to withstand high temperatures for hundreds of hours, particularly downstream of point I. For that, a refractory lining 6 is provided inside duct 3. In the embodiment illustrated schematically in FIG. 2, the refractory lining 6 of the invention, at least downstream of point I, comprises the following multi-layer structure:

(a) a first layer 7 of pure zirconia of thickness of 2 mm and having a specific gravity equal to 4.7, (b) a second layer 8 of pure zirconia, having a thickness of 6 mm and a specific gravity equal to 4, (c) a third layer 9 of a refractory LAFARGE SECAR 80 concrete charged with globular corindon, of a thickness of 40 mm with a linear expansion coefficient of 1.5, (d) a fourth layer 10 of a refractory silica and clay concrete (for example the one known commercially under the name GB D4) of a thickness of 40 mm.

Said first and second layers 7 and 8 may be formed in accordance with the known process, described more particularly in the above-mentioned French patent, which consists in projecting their constituent material melted by means of a heat source. This constituent material is initially in the form of a thread, which is driven towards said heat source. For forming the first layer 7, the heat source may be a plasma generator. On the other hand, for the formation of the second layer 8, the heat source may be only a simple flame.

The formation of the refractory coating 6 may take advantage of the presence of wall 3, using it as support. Layer 10 is in this case formed first of all on wall 3, then layer 9 on layer 10, layer 8 on layer 9 and finally layer 7 on layer 8.

On the other hand, layer 9 may be made in a mold (not shown), then layer 8 on layer 9 and layer 7 on layer 8. The monolithic structure of layers 7, 8 and 9 is then fixed to wall 3 by means of layer 10. Instead of concrete, layer 10 could be formed of rock wool or similar material, bonded if required to layer 9 and/or to wall 3.

Furthermore, said first and second layers 7 and 8 are not necessarily formed of zirconia. They may for example be formed from calcium zirconate, from magnesia or from a spinel whose double oxides are those of magnesium, aluminum or chromium.

The foregoing detailed description has been given for clearness of understanding only, and no unnecessary limitations should be understood therefrom as modifications will be obvious to those skilled in the art.

What is claimed is:

1. A multi-layer refractory structure capable of withstanding high temperatures of the order of 2000° C. to 2500° C. for hundreds of hours, comprising at least three layers, a first layer which is directly subjected to said high temperatures being formed from a simple or composite metal oxide or a zirconate and having a thickness between about 1 mm and 4 mm and a specific gravity between about 2.4 and 2.8;

a second layer which serves as support for said first layer having the same nature as said first layer and having a thickness between about 5 mm and 12 mm and a specific gravity between about 2.2 and 4.2; and a third layer adapted to be supported by a metal wall and serving as support for said second layer and being formed from a refractory concrete having a linear expansion coefficient between about 1.4 and $1.8\times10^{-6}$ per °C. and a thickness at least equal to 20 mm.

2. The multi-layer refractory structure as claimed in claim 1, wherein said third layer is made from a refractory concrete with a high alumina content.

3. The multi-layer refractory structure as claimed in claim 1, comprising a fourth refractory layer serving as connection between said third layer and said metal wall.

4. The multi-layer refractory structure as claimed in claim 3, wherein said fourth layer is made from refractory concrete, rock wool or similar material.

5. The multi-layer refractory structure as claimed in claim 1, wherein said first layer and/or said second layer are formed by hot projection.

6. The multi-layer refractory structure as claimed in claim 1, intended to be supported by a wall to be protected, and being formed layer after layer on said wall.

7. The multi-layer refractory structure as claimed in claim 1, intended to be supported by a wall to be protected, and formed layer after layer independently of said wall, then assembled thereto by means of a refractory layer.

* * * * *